US008033132B1

(12) United States Patent
Purser

(10) Patent No.: US 8,033,132 B1
(45) Date of Patent: Oct. 11, 2011

(54) SELF-COOLING BEVERAGE CONTAINER

(76) Inventor: Anh V. Purser, Sacramento, CA (US)

( * ) Notice: Subject to any disclaimer, the term of this patent is extended or adjusted under 35 U.S.C. 154(b) by 0 days.

(21) Appl. No.: 12/567,756

(22) Filed: Sep. 26, 2009

(51) Int. Cl.
*F25D 3/00* (2006.01)

(52) U.S. Cl. ..... 62/293; 62/294

(58) Field of Classification Search ..... 62/293, 62/294, 457.3, 457.4, 371; 220/592.17, 906; 426/131, 397, 524
See application file for complete search history.

(56) References Cited

U.S. PATENT DOCUMENTS 4,319,464 A * 3/1982 Dodd ..... 62/371
4,669,273 A * 6/1987 Fischer et al. ..... 62/294
5,131,239 A * 7/1992 Wilson ..... 62/293
5,331,817 A * 7/1994 Anthony ..... 62/5
5,447,039 A * 9/1995 Allison ..... 62/293
6,103,280 A * 8/2000 Molzahn et al. ..... 426/109
6,151,911 A * 11/2000 Dando et al. ..... 62/457.3
6,167,718 B1 * 1/2001 Halimi et al. ..... 62/293
2002/0088810 A1 * 7/2002 Murakami ..... 220/739
2002/0116942 A1 * 8/2002 Suh ..... 62/371
2003/0159448 A1 * 8/2003 Lee ..... 62/60
2005/0039317 A1 * 2/2005 Chen ..... 29/509
2005/0160745 A1 * 7/2005 Jeuch et al. ..... 62/60

* cited by examiner

*Primary Examiner* — Mohammad Ali

(57) ABSTRACT

A self-cooling beverage container includes a container body having a container interior, a beverage provided in the container interior, a gas compartment provided in the container body, a cooling gas provided in the gas compartment, a cooling compartment disposed in fluid communication with the gas compartment and disposed in the container interior, a gas compartment seal disposed between the gas compartment and the cooling compartment, a detachable element carried by the container body and a gas release pin carried by the detachable element and adapted to rupture the gas compartment seal upon detachment of the detachable element from the container body.

7 Claims, 4 Drawing Sheets

SELF-COOLING BEVERAGE CONTAINER

FIELD OF THE INVENTION

The present disclosure relates to beverage containers. More particularly, the present disclosure relates to a self-cooling beverage container which utilizes nitrogen or other cooling gas to cool a beverage.

BACKGROUND OF THE INVENTION

Beverages such as soft drinks and fruit juice are available in containers such as cans, cartons, bottles and the like. If the beverage containers are not stored in a cooler or refrigerator prior to consumption of the beverages contained therein, the beverages may be too warm for enjoyment.

Therefore, a self-cooling beverage container which utilizes nitrogen or other cooling gas to cool a beverage is needed.

SUMMARY OF THE INVENTION

The present disclosure is generally directed to a self-cooling beverage container. An illustrative embodiment of the self-cooling beverage container includes a container body having a container interior, a beverage provided in the container interior, a gas compartment provided in the container body, a cooling gas provided in the gas compartment, a cooling compartment disposed in fluid communication with the gas compartment and disposed in the container interior, a gas compartment seal disposed between the gas compartment and the cooling compartment, a detachable element carried by the container body and a gas release pin carried by the detachable element and adapted to rupture the gas compartment seal upon detachment of the detachable element from the container body.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Furthermore, there is no intention to be bound by any expressed or implied theory presented in the preceding technical field, background, brief summary or the following detailed description.

Figure 1:
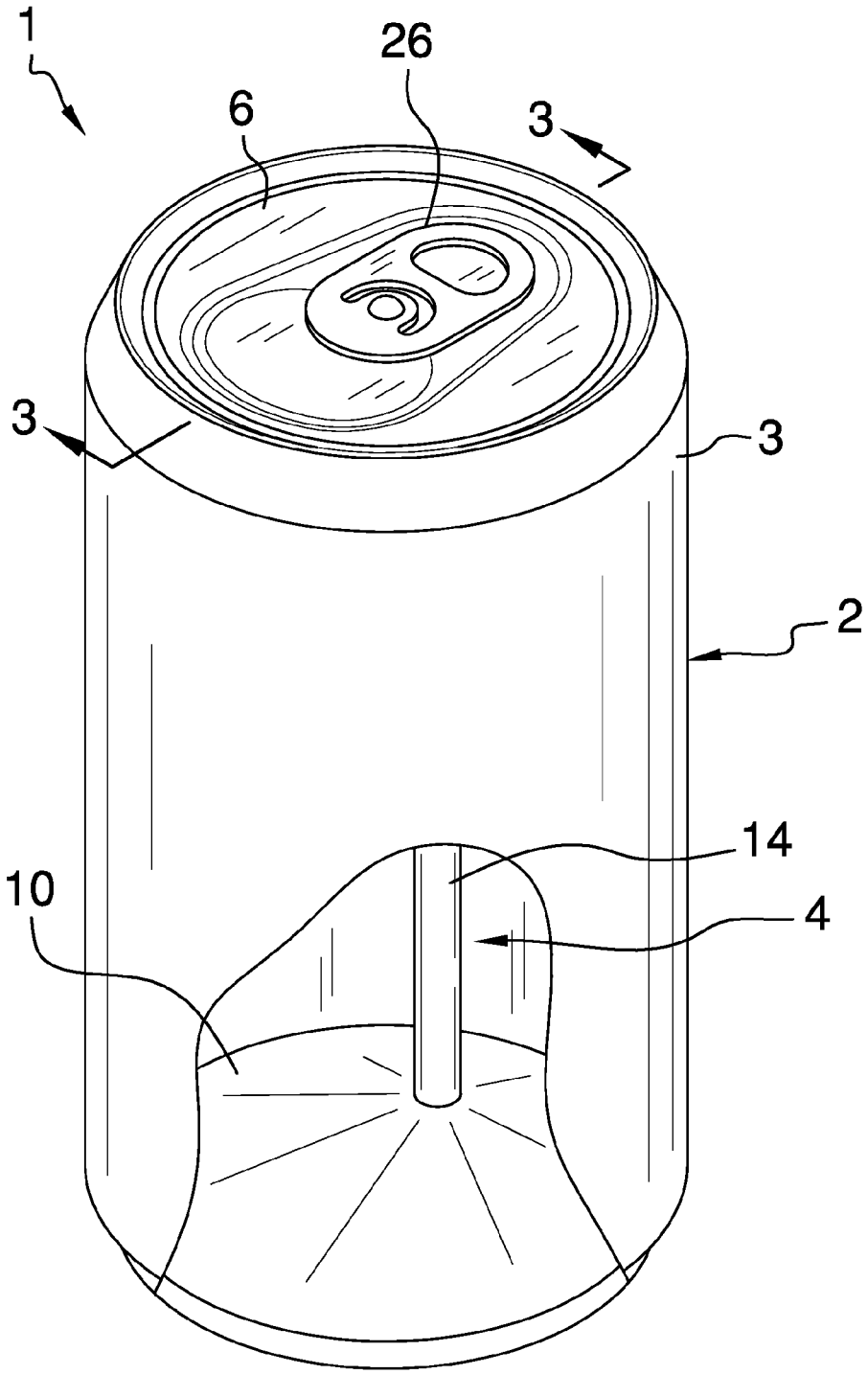
FIG. 1 is a perspective view, partially in section, of an illustrative embodiment of the self-cooling beverage container.
Figure 2:
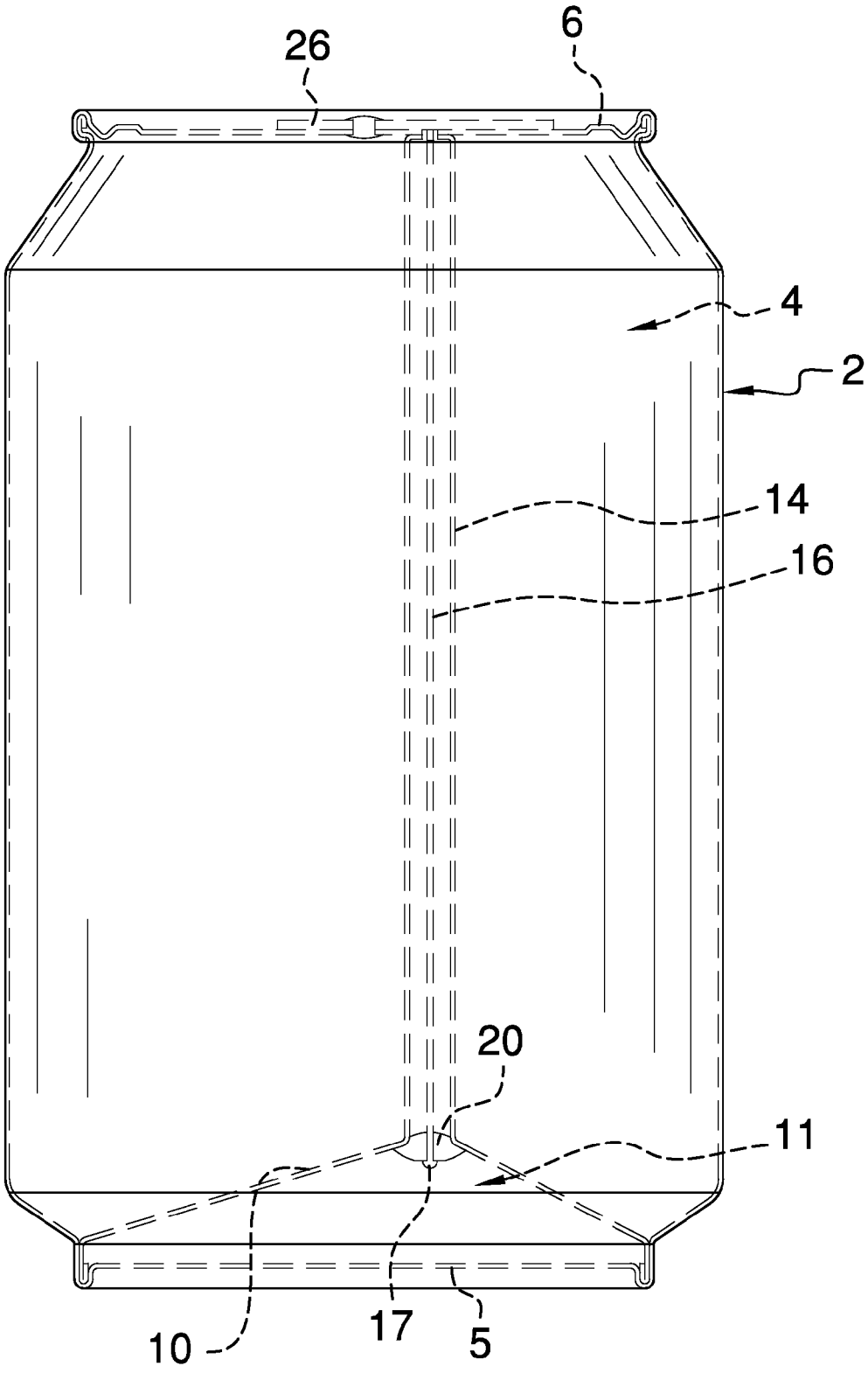
FIG. 2 is a side view of an illustrative embodiment of the self-cooling beverage container.
Figure 3:
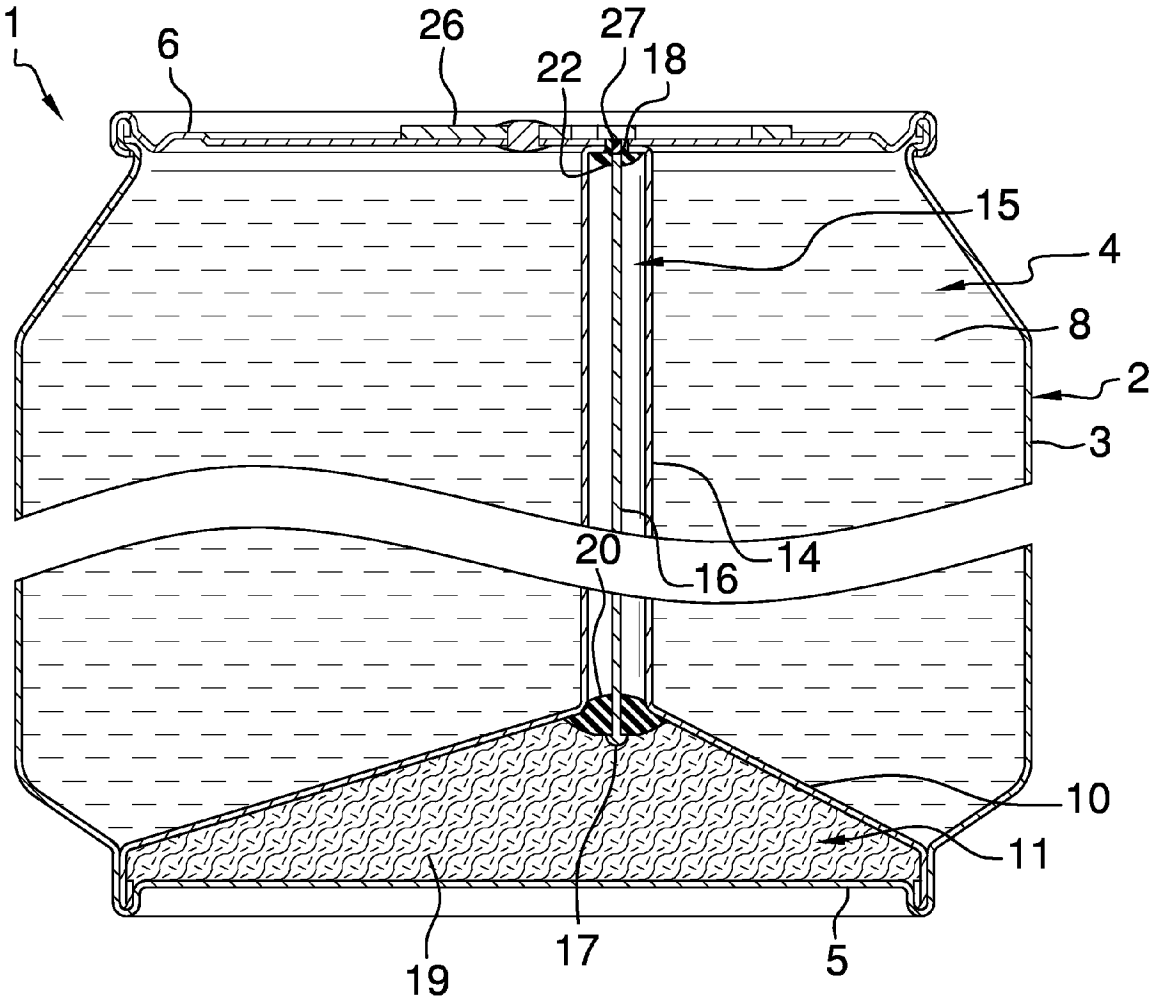
FIG. 3 is a longitudinal sectional view, taken along section lines 3-3 in FIG. 1, of an illustrative embodiment of the self-cooling beverage container.

Referring to the drawings, an illustrative embodiment of the self-cooling beverage container, hereinafter container, is generally indicated by reference numeral 1. The container 1 includes a container body 2 which may be in the form of a carton, bottle, can or other vessel which is suitable for containing a beverage 8 (FIG. 3). In some embodiments, the container 1 may be configured in the form of a can, as shown in the drawings. Accordingly, the container 1 may include a container body 2 having a generally cylindrical container body wall 3. A container interior 4 is defined by the container body wall and by a container bottom 5 and a container top 6 provided on the container body wall 3. A container opening (FIG. 4) may be provided in the container top 6 of the container body 2, through which container opening 7 the beverage 8 may be dispensed from the container 1. In some embodiments, a detachable element such as a tab 26 may be provided on the container top 6 and normally seals the container opening 7 typically in the conventional manner. Accordingly, selective removal of the tab 26 opens the container opening 7 for dispensing of the beverage 8 from the container interior 4. In other embodiments, the detachable element may be a lid, cap or other element which is detached from the container body 2 to facilitate dispensing of beverage 8 from the container interior 4.

A gas compartment 11 may be provided in the container body 2. In some embodiments, the gas compartment 11 may be provided in the lower portion of the container body 2. A gas compartment partition 10 may separate the gas compartment 11 from the container interior 4 of the container body 2. Accordingly, the gas compartment 11 may be defined by and between the gas compartment partition 10 and the container bottom 5 of the container body 2. In other embodiments, the gas compartment 11 may be provided in any other suitable location in the container body 2. As shown in FIG. 3, the gas compartment 11 contains a supply of cooling gas 19 such as nitrogen, for example and without limitation.

A cooling compartment 14 has a cooling compartment interior 15 which is disposed in fluid communication with the gas compartment 11. The cooling compartment 14 may extend from the gas compartment 11, through the container interior 4 and may terminate at the container top 6 of the container body 2. A gas compartment seal 20 may be provided at the junction between the gas compartment 11 and the cooling conduit interior 15 of the cooling conduit 14. A cooling compartment seal 22 may be provided at the junction of the cooling compartment 14 with the container top 6 of the container body 2.

An elongated gas release pin 16 may extend through the cooling compartment interior 15 and through the gas compartment seal 20 and the cooling compartment seal 22. A pin flange 17 may terminate the end of the gas release pin 16 which extends through the gas compartment seal 20. A tab pin end 18 terminates the end of the gas release pin 16 which extends through the cooling compartment seal 22. A pin connection 27 may connect the tab pin end 18 of the gas release pin 16 to the tab 26 or other detachable element provided on the container body 2. The pin connection 27 may be any type of breakable connection which breaks upon full opening of the tab 26 on the container top 6.

Figure 4:
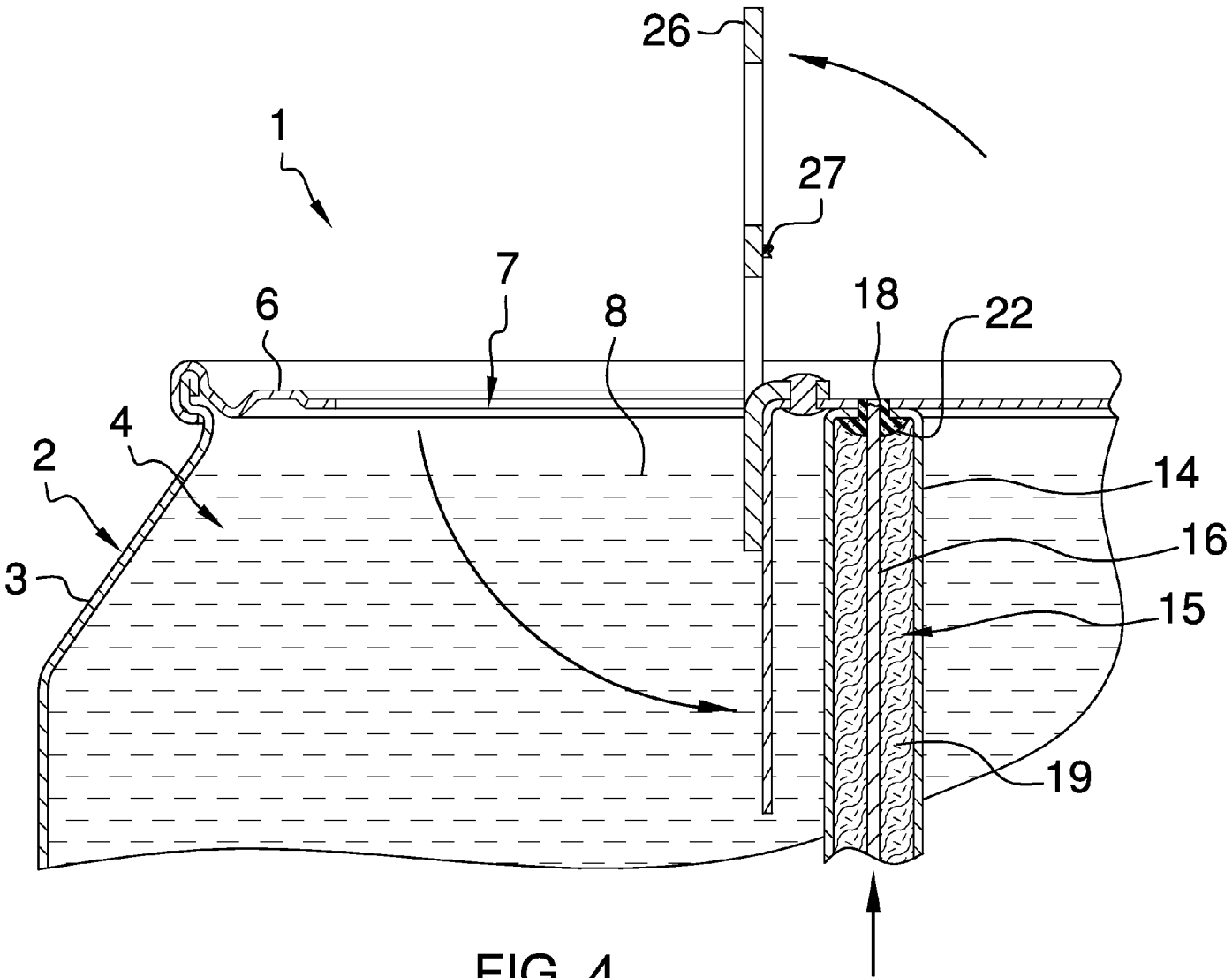
FIG. 4 is a sectional view of an illustrative embodiment of the self-cooling beverage container, with cooling gas filling a cooling chamber provided in the beverage container after opening of the container.

The container 1 may be fabricated with the beverage 8 provided in the container interior 4 of the container body 2 and the cooling gas 19 provided in the gas compartment 11. When extraction of the beverage 8 from the container interior 4 is desired, the tab 26 or other detachable element is grasped and unthreaded or pulled away from the container top 6, pulling and displacing the gas release pin 16 in the cooling compartment interior 15 and thereby causing the pin flange 17 to rupture the gas compartment seal 20. Continued opening of the tab 26 on the container top 6 causes detachment of the tab 26 from the tab pin end 18 at the pin connection 27 and exposure of the container opening 7. The cooling gas 19 flows from the gas compartment 11, through the ruptured gas compartment seal 20 and into the cooling compartment interior 15, as shown in FIG. 4. The cooling gas 19 cools the beverage 8 which is contained in the container interior 4 by conduction through the cooling compartment 14. Therefore, the beverage 8 is maintained in a cooled condition as the beverage 8 is dispensed from the container interior 4 through the container opening 7.

While the embodiments of the disclosure have been described above, it will be recognized and understood that various modifications can be made and the appended claims are intended to cover all such modifications which may fall within the spirit and scope of the disclosure.

What is claimed is:

1. A self-cooling beverage container, comprising:

a container body having a container interior;

a beverage provided in said container interior;

a gas compartment provided in said container body;

a cooling gas provided in said gas compartment;

a cooling compartment disposed in fluid communication with said gas compartment and disposed in said container interior;

a gas compartment seal disposed between said gas compartment and said cooling compartment;

a detachable element carried by said container body;

a gas release pin carried by said detachable element and adapted to rupture said gas compartment seal upon detachment of said detachable element from said container body; and a pin flange terminating said gas release pin and engaging said gas compartment seal.

2. The self-cooling beverage container of claim 1 wherein said container body comprises a can and said detachable element comprises a tab provided on said container body.

3. The self-cooling beverage container of claim 2 wherein said container body comprises a generally cylindrical container body wall and a container bottom and a container top provided on said container body wall.

4. The self-cooling beverage container of claim 3 wherein said tab is provided on said container top.

5. The self-cooling beverage container of claim 1 wherein said cooling gas comprises nitrogen.

6. A self-cooling beverage container, comprising:

a container body comprising:

a generally cylindrical container body wall;

a container top having a container opening and a container bottom provided on said container body wall; and a container interior defined by and between said container body wall, said container top and said container bottom;

a beverage provided in said container interior;

a gas compartment partition provided in said container interior;

a gas compartment defined by and between said gas compartment partition and said container bottom;

a cooling gas provided in said gas compartment;

a cooling compartment having a cooling compartment interior disposed in fluid communication with said gas compartment and disposed in said container interior;

a gas compartment seal disposed between said gas compartment and said cooling compartment;

a detachable element carried by said container top of said container body; and a gas release pin extending through said cooling compartment interior of said cooling compartment and having a first end detachably attached to said detachable element and a second end adapted to rupture said gas compartment seal upon detachment t, said detachable element from said container body; and a pin flange terminating said second end of said gas release pin and engaging said gas compartment seal.

7. The self-cooling beverage container of claim 6 wherein said cooling gas comprises nitrogen.

* * * * *